US011289816B2

(12) United States Patent
Othmezouri et al.

(10) Patent No.: US 11,289,816 B2
(45) Date of Patent: Mar. 29, 2022

(54) HELICALLY CORRUGATED HORN ANTENNA AND HELICALLY CORRUGATED WAVEGUIDE SYSTEM

(71) Applicants: TOYOTA MOTOR EUROPE, Brussels (BE); TEADE AB, Lindome (SE)

(72) Inventors: Gabriel Othmezouri, Brussels (BE); Harald Merkel, Lindome (SE)

(73) Assignees: TOYOTA MOTOR EUROPE, Brussels (BE); TEADE AB, Lindome (SE)

( * ) Notice: Subject to any disclaimer, the term of this patent is extended or adjusted under 35 U.S.C. 154(b) by 0 days.

(21) Appl. No.: 16/488,988

(22) PCT Filed: Feb. 28, 2017

(86) PCT No.: PCT/EP2017/054675

§ 371 (c)(1),
(2) Date: Aug. 27, 2019

(87) PCT Pub. No.: WO2018/157921

PCT Pub. Date: Sep. 7, 2018

(65) Prior Publication Data

US 2019/0393611 A1 Dec. 26, 2019

(51) Int. Cl.
*H01Q 13/02* (2006.01)
*H01P 3/123* (2006.01)

(52) U.S. Cl.
CPC ..... *H01Q 13/0208* (2013.01); *H01P 3/123* (2013.01)

(58) Field of Classification Search
CPC ..... H01Q 13/0208; H01Q 13/0291; H01Q 13/0216; H01Q 21/06; H01P 3/123
See application file for complete search history.

(56) References Cited

U.S. PATENT DOCUMENTS

| | | | | |
|---|---|---|---|---|
| 2,556,187 A | | 6/1951 | Ingalls | |
| 2,576,835 A | | 11/1951 | Hewitt, Jr. | |
| 3,732,571 A | * | 5/1973 | Neale | H01Q 13/0208 343/786 |
| 4,106,026 A | * | 8/1978 | Bui-Hai | H01Q 13/0208 343/786 |
| 4,231,042 A | * | 10/1980 | Turrin | H01P 1/16 333/21 R |

(Continued)

FOREIGN PATENT DOCUMENTS

| | | |
|---|---|---|
| EP | 0 024 685 A1 | 3/1981 |
| GB | 1 291 530 A | 10/1972 |

OTHER PUBLICATIONS

Liu Hong-Tao et al., "Accurate analysis of arbitrarily-shaped helical groove waveguide", Chinese Physics Soc., Institute of Physics, Sep. 2006, pp. 2114-2119, vol. 15, No. 9.

(Continued)

*Primary Examiner* — Seokjin Kim
(74) *Attorney, Agent, or Firm* — Sughrue Mion, PLLC

(57) ABSTRACT

The present disclosure relates to a horn antenna or waveguide system comprising a corrugated horn or waveguide, wherein the corrugation takes the form of a helical spiral along the inner surface of the horn or waveguide. The present disclosure further relates to radar antenna.

15 Claims, 4 Drawing Sheets

(56) References Cited

U.S. PATENT DOCUMENTS 4,419,671 A * 12/1983 Noerpel ..... H01P 1/16 333/21 R
4,521,783 A * 6/1985 Bryans ..... H01Q 19/192 343/781 CA
4,847,574 A * 7/1989 Gauthier ..... H01P 1/16 333/21 A
5,126,750 A * 6/1992 Wang ..... H01Q 19/08 343/786
5,689,275 A * 11/1997 Moore ..... H01Q 3/2676 343/772
6,005,528 A * 12/1999 Preiss ..... H01Q 13/0208 333/126
6,094,175 A * 7/2000 Alessi ..... H01Q 1/405 333/21 A
6,208,309 B1 * 3/2001 Chandler ..... H01Q 13/0216 343/772
6,937,203 B2 * 8/2005 Rao ..... H01Q 3/2658 333/125
9,716,316 B2 * 7/2017 Park ..... H01Q 21/08
10,256,531 B1 * 4/2019 Bhattacharyya ... H01Q 13/0216
2005/0104794 A1 * 5/2005 Rao ..... H01Q 3/2658 343/786
2010/0188309 A1 * 7/2010 Orime ..... H01Q 19/106 343/841
2014/0266948 A1 * 9/2014 Smith ..... H01Q 13/025 343/773
2017/0324164 A1 * 11/2017 Cook ..... H01Q 5/47
2018/0191076 A1 * 7/2018 Zelenski ..... H01Q 13/0275

OTHER PUBLICATIONS

M.I. Oksanen, "Space-harmonic analysis of multidepth corrugated waveguides", IEE Proceedings H. Microwaves, Antennas & Propagation, Institution of Electrical Engineers, Apr. 1989, pp. 151-158, vol. 136, No. 2, Part H.
International Search Report for PCT/EP2017/054675 dated Oct. 23, 2017 [PCT/ISA/210].
Written Opinion for PCT/EP2017/054675 dated Oct. 23, 2017 [PCT/ISA/237].

* cited by examiner

HELICALLY CORRUGATED HORN ANTENNA AND HELICALLY CORRUGATED WAVEGUIDE SYSTEM

CROSS REFERENCE TO RELATED APPLICATIONS

This application is a National Stage of International Application No. National Stage of PCT/EP2017/054675 filed Feb. 28, 2017.

FIELD OF THE DISCLOSURE

The present disclosure is related to a Helically corrugated horn antenna and a helically corrugated waveguide system, in particular configured for a THz and/or submillimeterwave signal transmission.

BACKGROUND OF THE DISCLOSURE

In independent antennas electromagnetically soft and hard boundaries are used for polarization. Such antennas are required for circular polarized radar which is superior in rain suppression. Unfortunately these boundaries cannot be incorporated in circular surfaces, waveguides, horns and reflector dishes more than narrowband frequencies (Narrowband indicating e.g. <5% of the RF band frequency).

Polarization independent boundaries are required for circular polarized radar systems. Such boundary conditions are modelled as parallel strips of perfect electric (PEC) and perfect magnetic conduction (PMC). For strips much smaller than the wavelength of operation, this results in a boundary condition, where both electric and magnetic fields are zero in one direction.

A PEC is easily implemented by a strip of ordinary metal. PMC surfaces require a waveguide section of a quarter wavelength depth (often dielectrically filled).

On a plane plate with plane wave fields, waveguide sections and metal ridges are interleaved with a lateral periodicity smaller than the wavelength of operation. This yields a perfect polarization independent boundary.

For fields with circular symmetry, it is mostly required to have the circular (phi-component) to be zero. This requires circular corrugated waveguides. Experiments show that these waveguides do not work. This is caused by standing waves in the corrugation. A corrugation acts only as perfect magnetic conductor when the length of the waveguide is an integer multiple of the wavelength of the first propagating mode of the waveguide. Thus, each groove must have individual depth and the bandwidth of the structure is very low.

In this context different approaches are known from the prior art. For example, R. B. Dybdal, W. Peak "Propagation in corrugated waveguides" Proc. IEE 1970, vol. 117 discloses corrugated waveguide where corrugations are closed structures.

A. D. R. Phelps, W. He "Gyro-travelling wave amplifier based on a thermionic cathode" Displays and Vacuum Electronics Conf. 2004 discloses a spiral corrugated waveguide to match a microwave signal to an electron beam.

A. Kishk, M. Morgan "Analysis of circular waveguides with soft and hard surfaces . . . " Radio Science—Volume 40, Issue 3—Page 155 discloses electromagnetically hard and soft waveguides to be realized by corrugations.

L. Zhang et. al. "Experimental Study of Microwave Pulse Compression Using a Five-Fold Helically Corrugated Waveguide" IEEE Transactions on Microwave Theory and Techniques 63(3):1090-1096—March 2015 discloses an experimental study of microwave pulse compression using a five-fold helically corrugated waveguide.

SUMMARY OF THE DISCLOSURE

Currently, it remains desirable to provide a corrugated horn antenna and a corrugated waveguide with polarization independent surfaces for reducing resonance buildup in the corrugations.

Therefore, according to embodiments of the present disclosure, a horn antenna and waveguide system is provided. The horn antenna comprises a corrugated horn, wherein the corrugation takes the form of a helical spiral along the inner surface of the horn. The waveguide system comprises a corrugated waveguide, wherein the corrugation takes the form of a helical spiral along the inner surface of the waveguide.

The corrugation has desirably a predetermined thread, the depths of the thread being modulated corresponding to a predetermined function along the main axis.

For example, said predetermined function may be:

$$f(z)=L0(1+\sin^2(w0*z)),$$

where L0 refers to the corrugation depth mean value [e.g. band center] and w0 to the Cosine of a wavelength of a signal close to the operation frequency (e.g. where the angle is given by the helical thread length). The positive effect of such a function is an increase of bandwidth of the waveguide.

Generally, the predetermined function may be chosen to define a modulated depth of the corrugations. For example, the waveguide may comprise corrugations where the depth is modulated along the corrugation length coordinates providing resonances at a multitude of frequencies and e.g. fulfilling the quarter wavelength criterion for a broad range of frequencies. This provides a large bandwidth waveguide.

Accordingly, by creating infinitely long corrugations in waveguides, there will always be a wave propagating in the corrugation. Therefore one can realize polarization independent surfaces in waveguide, horns, reflectors and other optical elements where propagation of circular polarized electromagnetic radiation is required. As a consequence, the problem of resonance buildup in the corrugations is removed. Furthermore, also the problem of low bandwidth in corrugated systems is overcome. Hence, electromagnetically soft and hard boundary conditions (working on planar surfaces in the Prior Art) are extended to waveguides and horns.

Electromagnetically soft and hard boundaries are used for polarization independent antennas. Such antennas are required for circular polarized radar which is superior in rain suppression. Unfortunately these boundaries cannot be incorporated in circular surfaces, waveguides, horns and reflector dishes. By reverting to spiral-like corrugations, the resonant problem is solved.

A horn may be understood as a means configured to gradually convert a guided wave to a free space wave.

The corrugation of the horn or waveguide may a spiral form running along a main axis of the horn or waveguide.

The surface of the horn or waveguide may comprise the helical corrugation.

The surface of the horn or waveguide may circumferentially surround the main axis at each section of the horn or waveguide.

The waveguide may form an antenna, e.g. a horn antenna.

The horn or waveguide may have a varying substantially rectangular cross section at each longitudinal section along the main axis.

The cross section may vary in size due to the helical corrugation.

The corrugation may be adapted to provide at least one resonance frequency, e.g. two different resonance frequencies.

Accordingly, it is possible to generate a multiple band horn antenna using subcorrugations.

The cross section may vary by varying the depth of the corrugation along the main axis such that resonances at a plurality of frequencies are provided.

The corrugation may change its cross section along the way around the horn or waveguide.

Several types of corrugation with different cross sectional properties may be wound around the horn or waveguide, e.g. with the same thread gain where the corrugation type interchanges.

The corrugation may consist of several subcorrugations that run in direction of the corrugation.

The corrugation may consist of several subcorrugations that run helically around at least a part of the corrugation such that the corrugation itself is corrugated.

The present disclosure further relates to a radar antenna, comprising the horn antenna as described above and/or the waveguide system as described above, e.g. an array of a plurality of horn antennas as described above and/or an array of a plurality of waveguide systems as described above.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DESCRIPTION OF THE EMBODIMENTS

Reference will now be made in detail to exemplary embodiments of the disclosure, examples of which are illustrated in the accompanying drawings. Wherever possible, the same reference numbers will be used throughout the drawings to refer to the same or like parts.

Figure 1A:
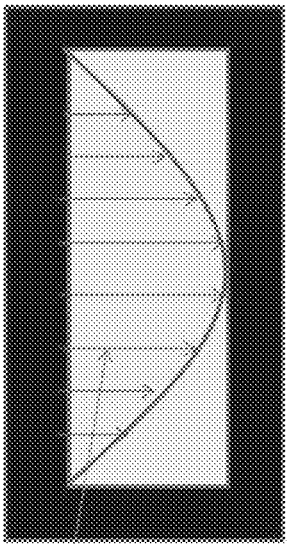
FIGS. 1A and 1B show schematic diagrams of fields in a rectangular waveguide as background of the present disclosure.
Figure 1B:
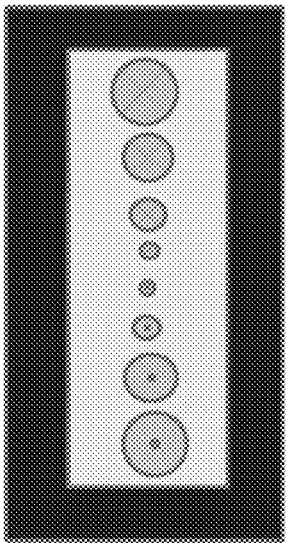

FIGS. 1A and A show schematic diagrams of fields in a rectangular waveguide as background of the present disclosure. The left diagram (FIG. 1A) shows the electric field in a rectangular waveguide (base mode). The right diagram (FIG. 1B) shows the magnetic field in a rectangular waveguide (base mode).

Figure 2:
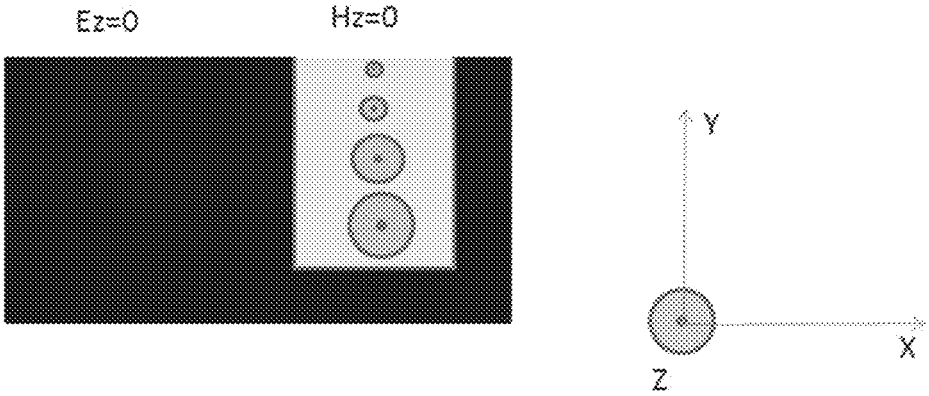
FIG. 2 shows schematic diagrams of fields in a half rectangular waveguide as background of the present disclosure.

FIG. 2 shows schematic diagrams of fields in a half rectangular waveguide as background of the present disclosure. In particular it is shown the model for a resonant corrugation. It is noted that the fields in a direction normal to the shown figure are zero independent of polarization.

Figure 3:
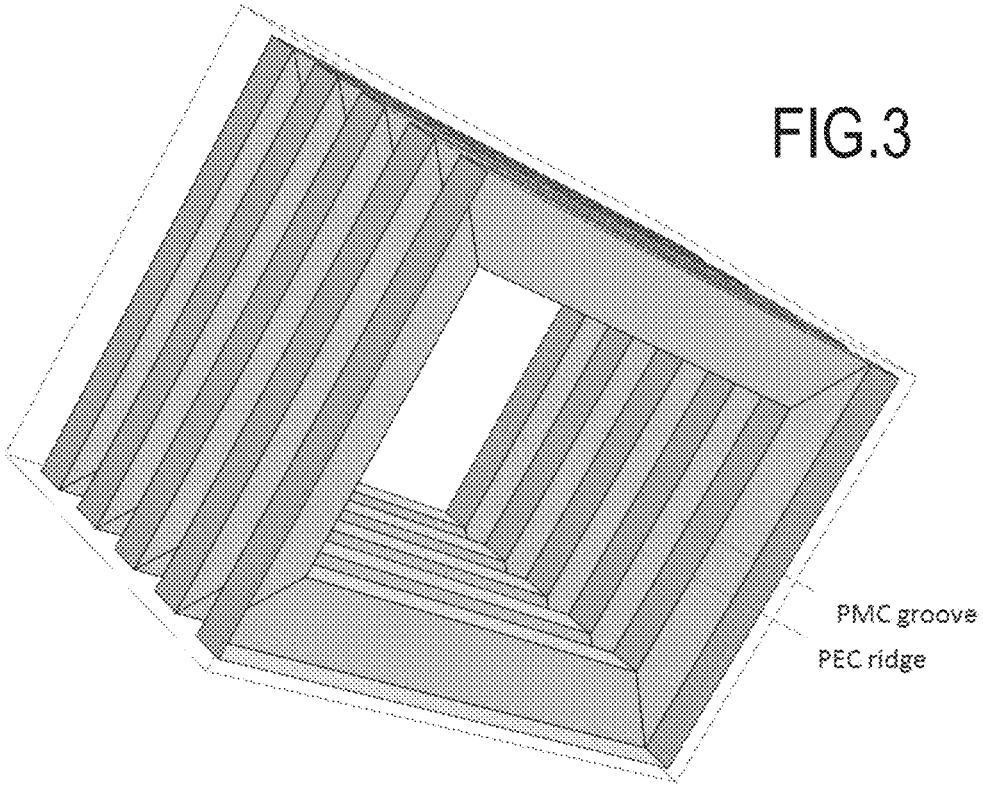
FIG. 3 shows a schematic representation of a Prior Art corrugated waveguide.

FIG. 3 shows a schematic representation of a Prior Art corrugated waveguide. In the waveguide corrugations form resonant rings around the waveguide. The main signal propagates perpendicular to the corrugations.

Figure 4:
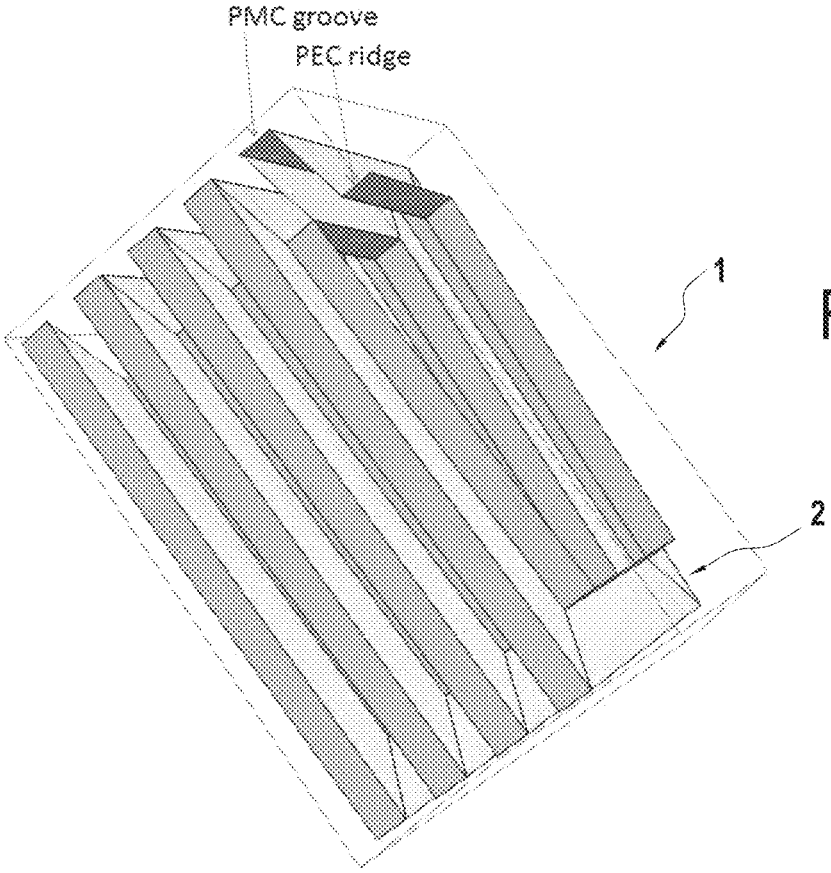
FIG. 4 shows a schematic representation of a helical waveguide for a single frequency according to an embodiment of the present disclosure.

FIG. 4 shows a schematic representation of a helical waveguide 1 for a single frequency according to an embodiment of the present disclosure. The corrugations 2 are modelled as parallel strips of perfect electric (PEC) walls on the circumferentially inner sider of the waveguide and perfect magnetic conduction (PMC) walls on the circumferentially outer sider of the waveguide.

In other words, the waveguide inner wall may comprise a PEC ridge and a PMC groove which are spirally running around the waveguide.

As shown in FIG. 4, the circular corrugations of FIG. 3 are transformed to spiral corrugations 2. So finally only one corrugation is created which is almost infinitely long and therefore a suitable propagation medium for radial waves. Adding some losses in the corrugation waveguide reduces spurious reflection lobes created by whispering gallery modes.

In a rectangular (or circular) waveguide the situation is similar: As soon as the corrugations are closed, only those fulfilling a "length is multiple of wavelength" will radiate, the others will not be present at all. This greatly the bandwidth of the structure.

Hence, a helical corrugation is created that is seen almost infinitely long that is winding through the waveguide. So any wave vector travelling in the large waveguide will be able to excite a whispering gallery mode in the corrugation guide and the surface will be polarization independent at an angle almost perpendicular to the direction of propagation.

The present disclosure may also be used for providing sets of corrugations acting at several individual frequencies.

Figure 5:
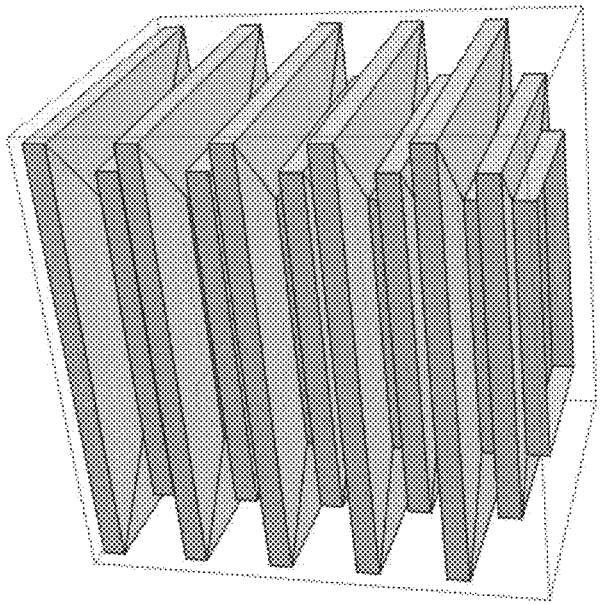
FIG. 5 shows a schematic representation of a Prior Art corrugated waveguide for double frequencies.
Figure 6:
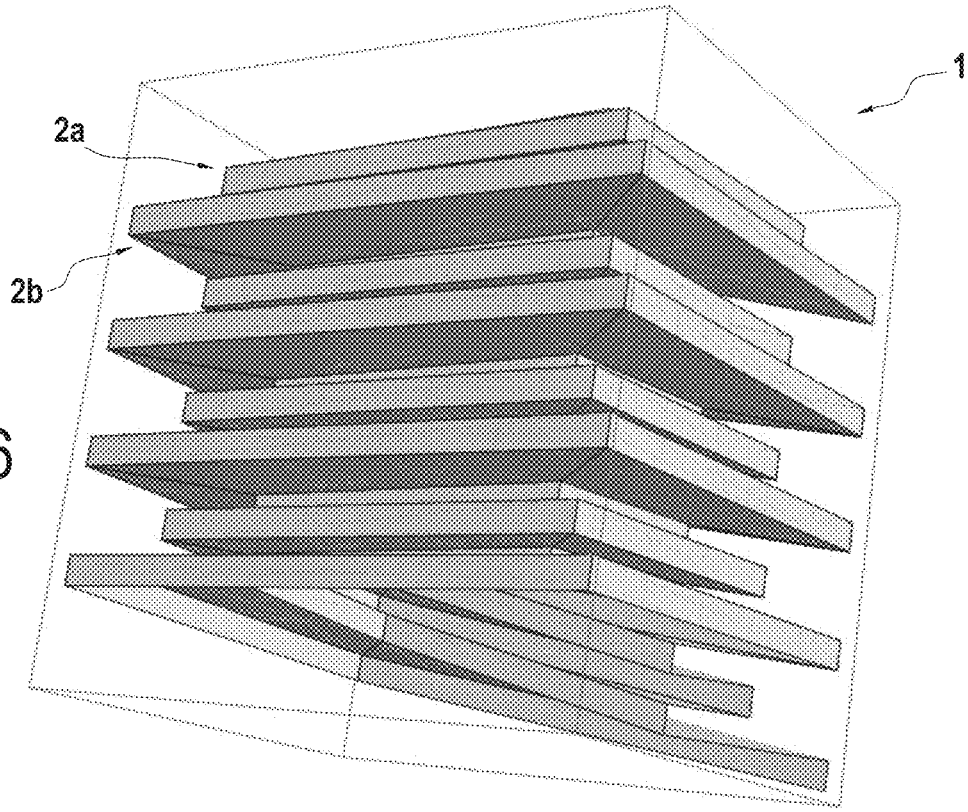
FIG. 6 shows a schematic representation of a helical waveguide for double frequencies according to an embodiment of the present disclosure.

For example, FIG. 5 shows a schematic representation of a Prior Art corrugated waveguide for double frequencies. FIG. 6 shows a schematic representation of a helical waveguide for double frequencies according to an embodiment of the present disclosure. As shown in FIG. 6, the circular corrugations of FIG. 5 are transformed to spiral corrugations 2*a*, 2*b* with different thread depth configured for the respective frequencies.

The present disclosure may also be used for multi-frequency corrugations

Figure 7:
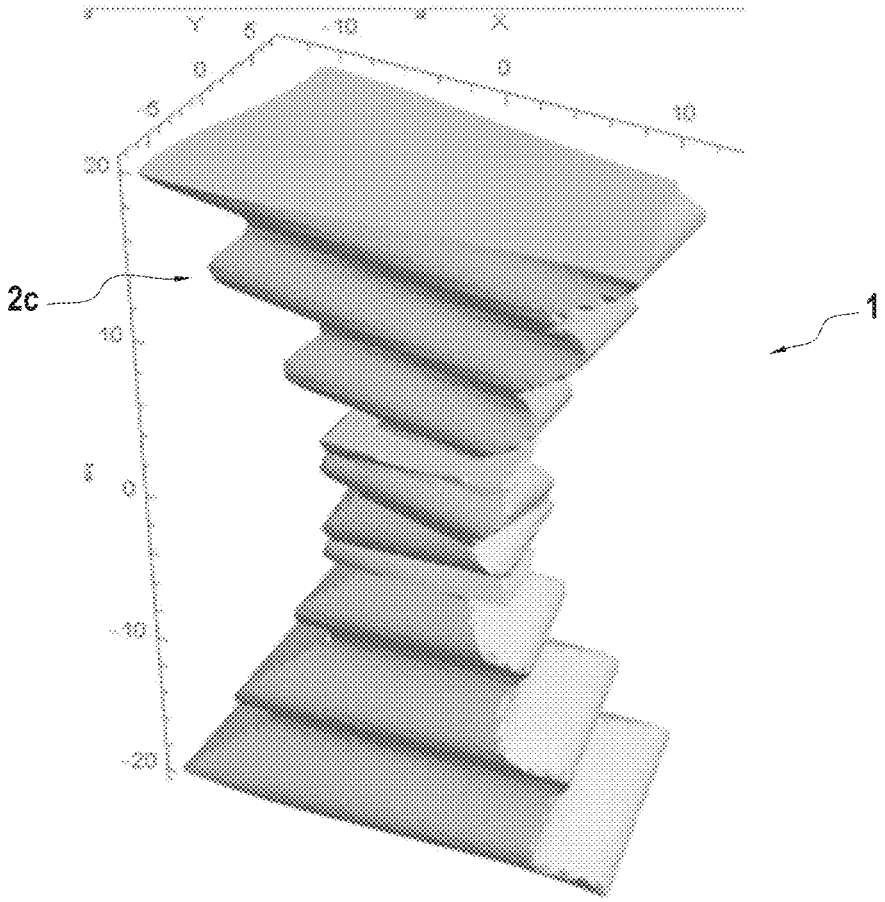
FIG. 7 shows a schematic representation of a helical waveguide with modulated depth according to an embodiment of the present disclosure.

FIG. 7 shows a schematic representation of a helical waveguide with modulated depth according to an embodiment of the present disclosure. Accordingly, the waveguide may also comprise corrugations where the depth is modulated along the corrugation length coordinates providing resonances at a multitude of frequencies and fulfilling the quarter wavelength criterion for a broad range of frequencies. This provides a large bandwidth waveguide.

It is noted that a horn antenna (not shown) may be obtained by successively increasing the width of the waveguide according to the disclosure. Hence, the waveguide's wall comprising the corrugations may be successively increased, in order to form a horn antenna.

Throughout the disclosure, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Furthermore the terms like "upper", "upmost", "lower" or "lowest" and suchlike are to be understood as functional terms which define the relation of the single elements to each other but not their absolute position.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A horn antenna comprising a corrugated horn, wherein the corrugation of the horn takes the form of a helical spiral along an inner surface of the horn, a cross section of the horn varies by varying a depth of the corrugation along a main axis of the horn such that resonances at a plurality of frequencies are provided, and several types of corrugation with different cross sectional properties are wound around the horn, wherein varying the depth of the cross section of the corrugation includes at least three different depths of the cross section of the corrugation along the main axis, the depth of the corrugation is varied corresponding to a predetermined function along the main axis, and the predetermined function takes into account at least one of a corrugation depth mean value and the cosine of a wavelength of a signal corresponding to an operation frequency.

2. The horn antenna according to claim 1, wherein the corrugation of the horn has a spiral form running along the main axis of the horn.

3. The horn antenna according to claim 1, wherein the surface of the horn comprises the helical corrugation.

4. The horn antenna according to claim 1, wherein the surface of the horn circumferentially surrounds the main axis at each section of the horn.

5. The horn antenna according to claim 1, wherein the horn has a varying substantially rectangular cross section at each longitudinal section along the main axis.

6. The horn antenna according to claim 1, wherein the cross section of the horn varies in size due to the helical corrugation.

7. The horn antenna according to claim 1, wherein the corrugation is adapted to provide two different resonance frequencies.

8. A waveguide system comprising a corrugated waveguide, wherein the corrugation of the waveguide takes the form of a helical spiral along an inner surface of the waveguide, the corrugation having a predetermined thread, depths of the thread are modulated corresponding to a predetermined function along a main axis of the waveguide, and several types of corrugation with different cross sectional properties are wound around the waveguide, wherein the several types of corrugation with different cross sectional properties include at least three different depths of corrugations with respect to the main axis, and the predetermined function takes into account at least one of a corrugation depth mean value and a cosine of a wavelength of a signal corresponding to an operation frequency.

9. The waveguide system according to claim 8, wherein the corrugation changes its cross section along the way around the waveguide.

10. The waveguide system according to claim 8, wherein the corrugation consists of several subcorrugations that run in a direction of the corrugation.

11. The waveguide system according to claim 8, wherein the corrugation consists of several subcorrugations that run helically around at least a part of the corrugation such that the corrugation itself is corrugated.

12. The waveguide system according to claim 8, wherein the waveguide forms a horn antenna.

13. The horn antenna according to claim 1, wherein the depth of the cross section of the corrugation is varied nonperiodically along the main axis.

14. The horn antenna according to claim 1, wherein varying the depth of the cross section of the corrugation produces at least three types of corrugation with different cross sectional properties wound around the horn.

15. A horn antenna comprising a corrugated horn, wherein the corrugation of the horn takes the form of a helical spiral along an inner surface of the horn, a cross section of the horn varies by varying a depth of the corrugation along a main axis of the horn such that resonances at a plurality of frequencies are provided, and several types of corrugation with different cross sectional properties are wound around the horn, wherein the depth of the corrugation is varied corresponding to a predetermined function along the main axis, and the predetermined function takes into account at least one of a corrugation depth mean value and the cosine of a wavelength of a signal corresponding to an operation frequency.

* * * * *